US005776267A

United States Patent [19]

Nanba et al.

[11] Patent Number: 5,776,267

[45] Date of Patent: Jul. 7, 1998

[54] SPRING STEEL WITH EXCELLENT RESISTANCE TO HYDROGEN EMBRITTLEMENT AND FATIGUE

[75] Inventors: Shigenobu Nanba; Hiroshi Yaguchi; Masataka Shimotsusa; Nobuhiko Ibaraki; Takenori Nakayama; Takashi Iwata; Yoshinori Yamamoto; Norio Ohkouchi; Mamoru Nagao, all of Kobe, Japan

[73] Assignee: Kabushiki Kaisha Kobe Seiko Sho, Kobe, Japan

[21] Appl. No.: 728,530

[22] Filed: Oct. 9, 1996

[30] Foreign Application Priority Data

| | | | |
|---|---|---|---|
| Oct. 27, 1995 | [JP] | Japan | 7-280931 |
| Oct. 27, 1995 | [JP] | Japan | 7-280932 |
| Aug. 9, 1996 | [JP] | Japan | 8-211708 |

[51] Int. Cl.[6] ..... C22C 38/02

[52] U.S. Cl. ..... 148/328; 148/908

[58] Field of Search ..... 148/328, 908; 420/118, 125, 126, 12

[56] References Cited

U.S. PATENT DOCUMENTS

| | | | |
|---|---|---|---|
| 4,909,866 | 3/1990 | Abe et al. | 148/908 |
| 5,284,529 | 2/1994 | Shikanai et al. | 148/328 |

FOREIGN PATENT DOCUMENTS

| | | |
|---|---|---|
| 1 950 004 | 4/1971 | Germany . |
| 31 24 977 | 4/1982 | Germany . |

OTHER PUBLICATIONS

English Abstract of De 1 950 004, Apr. 22, 1971.
English Abstract of De 31 24 977, Apr. 29, 1982.

*Primary Examiner*—Deborah Yee
*Attorney, Agent, or Firm*—Oblon, Spivak, McClelland, Maier & Neustadt, P.C.

[57] ABSTRACT

The present invention provides a spring steel with excellent performance, characterized in that the spring steel is produced by making a spring steel contain an appropriate amount of at least one or more of Ti, Nb, Zr, Ta, and Hf, thereby generating fine inclusions including carbide, nitride, sulfides and/or their complex compounds, to make the inclusions exert the effect of trapping diffusive hydrogen whereby the resistance to hydrogen embrittlement is enhanced, wherein the size and number of the coarse inclusions are regulated, thereby suppressing the decrease of the fatigue life. The spring steel can provide a valve spring or a suspension spring or the like, with enhanced strength and higher stress resistance, together with improved resistance to hydrogen embrittlement and fatigue.

13 Claims, No Drawings

SPRING STEEL WITH EXCELLENT RESISTANCE TO HYDROGEN EMBRITTLEMENT AND FATIGUE

BACKGROUND OF THE INVENTION

1. Field of the Invention

The present invention relates to a spring steel useful as a material for the valve spring, suspension spring, stabilizer, torsion bar of the internal combustion engines of automobiles and the like; more specifically, the present invention relates to a spring steel generating a spring with excellent resistance to hydrogen embrittlement and good fatigue as significant spring properties.

2. Description of the Prior Art

The chemical compositions of spring steels are specified in JIS G3565 to 3567, 4801 and the like. By use of these spring steels, various springs are manufactured by the steps of: hot-rolling each spring steel into a hot-rolled wire rod or bar (hereinafter, referred to as "rolled material"); and drawing the rolled material to a specified diameter and then cold forming the wire into a spring after oil-tempering, or drawing the rolled material or peeling and straightening the rolled material, heating and forming the wire into a spring, and quenching and tempering it. Recently, there have been strong demands toward the characteristics of springs, and to meet these demands, alloy steels subjected to heat treatment have been extensively used as the materials of the springs.

On the other hand, there is a tendency in the field of automobile toward the enhancement of the stress of a spring as a part of measures of achieving lightweightness for reducing exhaust gas and fuel consumption. Namely, in the field of automobile, there is required a spring steel for a high strength spring which has a strength after quenching and tempering of 1,800 MPa or more. However, as the strength of a spring is enhanced, the sensitivity against defects is generally increased. In particular, the high strength spring used in a corrosion environment is deteriorated in corrosion fatigue life, and is fear of early causing the breakage.

One of the factors deteriorating the corrosion fatigue life includes hydrogen embrittlement due to the hydrogen generated following the progress of corrosive reaction. As a countermeasure for improving such phenomenon, a method comprising adding vast amounts of various alloy elements to a spring to give the spring a higher stress resistance, has been adopted. However, such method is economically problematic because the steel material is costly.

In order to suppress hydrogen embrittlement, it is effective that refining the grain size and dispersing fine precipitates such as carbides/nitrides. Therefor, carbides/nitrides forming elements has been added to steels. Addition of such elements improve the toughness of spring steels through the effect of refining the grain size, while it is wondered that coarse inclusions including carbides/nitrides deteriorate the fatigue life as one of most important properties of spring steels.

SUMMARY OF THE INVENTION

With attention focused on the problems described above, the present invention has been carried out, and an object of the present invention is to provide a spring steel of a wire, a bar or a plate form, which can produce a spring (including valve springs, suspension springs, plate springs and the like) with high strength and high resistance of corrosion and hydrogen embrittlement.

To achieve the above object according to the present invention, there is provided a spring steel of high strength and excellent resistance to corrosion and hydrogen embrittlement containing Ti at 0.001 to 0.5 mass % (hereinafter referred to as %), Nb at 0.001 to 0.5%, Zr at 0.001 to 0.5%, Ta at 0.001 to 0.5% and Hf at 0.001 to 0.5%, and also contains N of 1 to 200 ppm and S of 5 to 300 ppm, wherein a great number of fine precipitates having an average particle size of less than 5 μm and including carbides, nitrides, sulfides and their complex compounds (hereinafter referred to as "carbo-nitro-sulfides" which include carbides, nitrides, sulfides and their complex compounds), at least one element selected from the group consisting of Ti, Nb, Zr, Ta and Hf, are dispersed in the following testing area; testing area; cross section being defined by a region of a depth more than 0.3 mm from the surface not including the center part and having an area of 20 $mm^2$.

Because "carbo-nitro-sulfides" as coarse inclusions having an average particle size of 5 μm or more and including at least one element selected from the group consisting of Ti, Nb, Zr, Ta, and Hf in the testing area adversely affect the fatigue life, the inclusions should be limited preferably in a manner so as to satisfy the following requirements, whereby a spring steel with more excellent resistance to hydrogen embrittlement and fatigue, can be obtained.

The size and number of coarse inclusions; the number of coarse inclusions of an average particle size of 5 to 10 μm should be 500 or less; the number of coarse inclusions of an average particle size of more than 10 μm to 20 μm or less should be 50 or less; and the number of coarse inclusions of an average particle size of more than 20 μm should be 10 or less.

When the above spring steel further contains 1.0% of V or less, V works as "carbo-nitro-sulfides" forming element. Then, in case of fine precipitates and coarse inclusions including at least one element selected from the group consisting of Ti, Nb, Zr, Ta, Hf and V, satisfy the above requirements, the spring steel can possibly enhance its performance.

In accordance with the present invention, furthermore, the spring steel should preferably have an prior austenite grain diameter of 20 μm or less after quenching and tempering, an HRC hardness of 50 or more and a fracture toughness value (KIC) of 40 $MPam^{1/2}$ or more, so as to greatly enhance properties as spring steel such as toughness, durability, sag resistance and the like.

The spring steel of the present invention is essentially characterized in that the type, size and number of "carbo-nitro-sulfides" should be regulated as described above, and that other elements contained therein are not with specific limitation. Preferable elements contained and elements to be eliminated are as follows. The reason why the preferable contents of the individual elements are determined will be described later in detail.

(1) At least one element selected from the group consisting of Ni at 3.0% or less (preferably 0.05 to 3.0%), Cr at 5.0% or less (preferably, 0.05 to 5.0%), Mo at 3.0% or less (preferably, 0.05 to 3.0%) and Cu at 1.0% or less (preferably, 0.01 to 1.0%).

(2) At least one element selected from the group consisting of Al at 1.0% or less (preferably, 0.005 to 1.0%), B of 50 ppm or less (preferably, 1 to 50 ppm), Co at 5.0% or less (preferably, 0.01 to 5.0%) and W at 1.0% or less (preferably, 0.01 to 1.0%).

(3) At least one element selected from the group consisting of Ca of 200 ppm or less (preferably, 0.1 to 200 ppm), La at 0.5% or less (preferably, 0.001 to 0.5%), Ce at 0.5% or less (preferably, 0.001 to 0.5%) and Rem at 0.5% or less (preferably, 0.01 to 0.5%).

(4) The steel preferably contains C in the range from 0.3% to 0.7%, Si at 0.1 to 4.0% and Mn at 0.005 to 2.0% as the essential components, with the balance being essentially Fe and inevitable impurities.

(5) The inevitable impurities in the steel include P at 0.02% or less; other impurities contained therein are Zn of preferably 60 ppm or less, Sn of preferably 60 ppm or less, As of preferably 60 ppm or less and Sb of preferably 60 ppm or less; the steel further satisfying the following formula (1) as required can enhance its performance as a spring steel:

$$2.5 \leqq (FP) \leqq 4.5 \quad (1)$$

where FP=(0.23 |C|+0.1)×(0.7|Si|+1)×(3.5|Mn|+1)×(2.2 |Cr|+1)×(0.4|Ni|+1)×(3|Mo|+1 in which |element| represents mass % of each element.

MODE OF CARRYING OUT THE INVENTION

So as to prevent the decrease of the toughness of a spring steel with the increase of the strength, refining prior austenite grain size has been adopted conventionally. From such respect, various methods to increase toughness with fine grains by adding elements generating carbides and/or nitrides into steels have been proposed.

In the field of spring steel, however, the concept to limit the size of carbides and nitrides from the respect of improving the hydrogen embrittlement has not been proposed. As has been described above or as will be described in detail hereinbelow, it has been found that the resistance to hydrogen embrittlement of a spring steel can be enhanced markedly when an appropriate amount of at least one element selected from the group consisting of Ti, Nb, Zr, Ta and Hf is contained in the spring steel to generate fine precipitates of "carbo-nitro-sulfides".

The reason is considered as follows. The hydrogen embrittlement of a spring steel possibly may be due to the occurrence of brittle fracture at a prior austenite grain boundary where the hydrogen penetrated into the steel is diffused and decreased the bonding energy. The fine precipitates of "carbo-nitro-sulfides" containing the elements mentioned above, trap the hydrogen penetrated into the inside of the steel, whereby the hydrogen embrittlement may be suppressed potentially. Adversely, there are some fear that the inclusions may become coarse when the elements forming the "carbo-nitro-sulfides" are added, and the resulting coarse inclusions may possibly cause early fracture.

As a technique to improve spring steels with attention focused on the coarse inclusions of oxides, a method controlling the composition of oxide inclusions in a valve spring steel has been proposed, whereby the ductility of the oxide inclusions is increased to achieve the improvement of the toughness, on the basis of the finding that cracking starts from inclusions having an average particle size of about 30 μm or more and being around near the surface. As the progress in the technique which makes oxide inclusions harmless described above, however, the problem of early fracture due to the inclusions of Ti nitrides instead of oxides, in particular, has been remarked. Research works to eliminate any Ti source among steel production process have made progress in recent years. It is not satisfactory for achieving higher stress resistance and higher tensile strength to adopt the technique that makes oxides inclusions harmless as described above. It is necessary to improve resistance to hydrogen embrittlement and corrosion.

In order to improve corrosion resistance, the addition of vast amounts of alloy metals is the most effective method, but the method is economically disadvantageous because the materials are costly and another production process such as annealing should be essentially needed. However, when a small amount of at least one or more selected elements from the group consisting of Ti, Nb, Zr, Ta and Hf is added to the spring steel as described above, thereby forming fine precipitates of "carbo-nitro-sulfides" including their elements and having an average particle size of less than 5 μm and being finely dispersed, the effect of trapping diffusive hydrogen is exerted to increase the resistance to hydrogen embrittlement.

The increase of the amount of coarse inclusions by adding a large amount of these elements may potentially lead to shorter fatigue life and lower toughness which is caused by coarse inclusions working as the fracture origin. Therefore, further investigations have been made to suppress shortening the fatigue life, due to coarse inclusions as the origin of fatigue fracture, while keeping the effect of improving the resistance to hydrogen embrittlement by the addition of the elements described above. Then, it has been found that the resistance to hydrogen embrittlement can be markedly enhanced with no occurrence of the deterioration of the fatigue life and toughness which deterioration is due to "carbo-nitro-sulfides" including the elements mentioned before as the origin of fatigue fracture, by controlling the cooling rate during the solidification process for casting a spring steel, thereby regulating the size and number of the "carbo-nitro-sulfides".

The reasons of the limitation of the inclusions in accordance with the present invention will be described in detail.

In accordance with the present invention, fine precipitates of "carbo-nitro-sulfides" including at least one element selected from the group consisting of Ti, Nb, Zr, Ta and Hf, should be formed for trapping diffusive hydrogen, and such effect of trapping diffusive hydrogen is efficiently exerted by the fine precipitates of an average particle size of less than 5 μm; even such "carbo-nitro-sulfides" cannot have the effect of improving the resistance to hydrogen embrittlement as intended in accordance with the present invention, if they are coarse inclusions of an average particle size above 5 μm. More specifically, super-fine precipitates in size of 10 nm to 5 μm efficiently work for the improvement of the resistance to hydrogen embrittlement with no adverse effect on the fatigue life. Hence, such precipitates can markedly enhance the overall properties as a spring steel.

This may be because the finely dispersed precipitates can trap diffusive hydrogen in the spring steel whereby the hydrogen embrittlement due to diffusive hydrogen is suppressed. On contrast, coarse inclusions massively trap diffusive hydrogen, which may adversely enhance the hydrogen embrittlement. In order that the fine precipitates can effectively exert improving the resistance to hydrogen embrittlement, in any way, the "carbo-nitro-sulfides" consisting of the elements should be as fine as those of an average particle size of less than 5 μm. Coarse inclusions whose average particle size is larger than 5 μm, do not only exert the improving effects of the resistance to hydrogen embrittlement, but deteriorate fatigue life, because they work as the origin of fatigue fracture.

Furthermore, the fine precipitates of "carbo-nitro-sulfides" described above, having an average particle size of less than 5 μm, which contribute to the improvement of the resistance to hydrogen embrittlement, can efficiently exert the effect as the size thereof is smaller while the number thereof is greater. It is currently confirmed that improving the resistance to hydrogen embrittlement through the effect of trapping diffusive hydrogen can be efficiently exerted if the number of the finely dispersed precipitates present in a testing face is 1,000 or more, preferably 5,000 or more and most preferably 10,000 or more. Additionally, such fine precipitates never work as a fatigue fracture origin determining fatigue life. Herein, the term "average particle size of the precipitates" means the value of (the long diameter+the short diameter)/2, and the ratio of the long diameter to the short diameter of the precipitates is 3.0 or less.

If the "carbo-nitro-sulfides" present in a testing face being defined by a region at a depth of 0.3 mm or more from the cross sectional surface of the spring steel with no center included and having an area of 20 $mm^2$ are of larger sizes, they adversely influence the effect of improving the resistance to hydrogen embrittlement; additionally, they work as an origin of fatigue fracture to significantly affect the fatigue life as a spring steel, adversely. So as to demonstrate the quantitative standard, investigations have been made of the size and number of the coarse inclusions. Consequently, it has been found that only if cooling conditions and the like during casting are satisfactorily controlled so that coarse inclusions of the "carbo-nitro-sulfides" having an average particle size of 5 μm or more might meet the following requirements, the adverse effect of the coarse inclusions on the resistance to hydrogen embrittlement and the fatigue can be suppressed to such an extent as negligible in a practical sense;

size and number of coarse inclusions;

number of inclusions of an average particle size of 5 to 10 μm should be 500 or less;

number of inclusions of an average particle size of more than 10 μm to 20 μm or less should be 50 or less; and number of inclusions of an average particle size of more than 20 μm is 10 or less.

In accordance with the present invention, therefore, the "carbo-nitro-sulfides" of a size above 5 μm should be controlled so that the size and number thereof might meet the aforementioned requirements. Because the "carbo-nitro-sulfides" tend to be precipitated at a higher temperature of 1400° to 1500° C. and gradually grow coarsely at the subsequent cooling process, the cooling rate during casting should be increased to preferably 0.1° C./second or more, and more preferably 0.5° C./second or more, to suppress to form coarse inclusions as much as possible.

In accordance with the present invention, thus, an infinite number, specifically 1,000 or more, preferably 5,000 or more, and further more preferably 10,000 or more of the fine precipitates of the "carbo-nitro-sulfides" having an average particle size of less than 5 μm should be precipitated in their dispersed state in the steel, whereby the effect of trapping diffusive hydrogen is efficiently exerted to procure the distinctive improvement of the resistance to hydrogen embrittlement. Because the coarse inclusions of the "carbo-nitro-sulfides" having an average particle size of 5 μm or more cannot have the effect of improving the resistance to hydrogen embrittlement through the trapping of diffusive hydrogen or such inclusions adversely affect the fatigue life as the inclusions work as the origin of fatigue fracture, furthermore, inclusions of an average particle size of 5 to 10 μm should be suppressed to a number of 500 or less (more preferably, 300 or less); inclusions of an average particle size of more than 10 μm to 20 μm or less should be suppressed to a number of 50 or less (more preferably, 30 or less); and inclusions of an average particle size of more than 20 μm should be suppressed to a number of 10 or less (more preferably, 5 or less, and most preferably, substantially zero), as described above. Thus, a spring steel with excellent resistance to hydrogen embrittlement and fatigue can be achieved.

The reason why the chemical components of the steel to be used in accordance with the present invention should be defined will be described below.

The steel to be used in accordance with the present invention should contain at least one selected from the group consisting of Ti at 0.001 to 0.5%, Nb at 0.001 to 0.5%, Zr at 0.001 to 0.5%, Ta at 0.001 to 0.5% and Hf at 0.001 to 0.5%, as metal elements to form the fine "carbo-nitro-sulfides" as described above, wherein the N content should be controlled within the range of 1 to 200 ppm while the S content should be controlled within the range of 10 to 300 ppm.

Any element selected from the group consisting of Ti, Nb, Zr, Ta and Hf can form "carbo-nitro-sulfides", and is an essential elements to precipitate "carbo-nitro-sulfides" inside the grain or in the grain boundary in the spring steel, which trap diffusive hydrogen as a factor causing hydrogen embrittlement thereby increasing the resistance to hydrogen embrittlement. Additionally, the formed "carbo-nitro-sulfides" can make prior austenite grain size finer, and increase of the toughness and sag resistance. In order that such effects can be exerted efficiently, at least one of the five elements should be contained at 0.001% or more, more preferably 0.005% or more. If the contents thereof are too excess, however, the amount of "carbo-nitro-sulfides" inclusions generated during a solidification process for casting are too much, and along with the increase of the number, the inclusions adversely affects the fatigue life, significantly. Hence, the contents should be 0.5% or less, preferably 0.2% or less, individually.

In order that N and S may form nitrides together with the five elements described above to efficiently trap diffusive hydrogen and exert the effect of refining austenite grain, N should be contained at 1 ppm at least or more, preferably 5 ppm, more preferably 10 ppm; S should be contained at 5 ppm or more, and preferably 10 ppm or more. If the contents are too excess, however, the size and number of the "carbo-nitro-sulfides" inclusions are increased to adversely affect the fatigue life. Thus, N should be suppressed to 200 ppm or less, preferably 100 ppm or less, and most preferably 70 ppm; and S should be suppressed to 300 ppm or less, preferably 200 ppm or less and more preferably 150 ppm or less.

Other elements contained in the steel to be used in accordance with the present invention are without specific limitation, but preferable ones will be described below, in terms of securing the generally required performance as spring steel or in terms of further enhancing the properties.

In accordance with the present invention, firstly, V should be contained at about 0.005% or more, and preferably 0.01% or more, as an element forming "carbo-nitro-sulfides", other than the element selected from the group consisting of Ti, Nb, Zr, Ta and Hf. In other words, an appropriate amount of V can form fine precipitates of "carbo-nitro-sulfides" to exert the effects of further enhancing the resistance to hydrogen embrittlement and the fatigue life, and to additionally exert the effect of refining prior austenite grain size to increase the toughness and proof stress, together with the contribution to the improvement of the corrosion resistance and sag resistance. If the amount is too much, however, the amount of carbides not to be resolved into austenite during heating for austenitization is increased with the result that satisfactory strength and hardness can hardly be attained.

Thus, the content should be suppressed to 1.0% or less, more preferably 0.5% or less.

In the steel containing V, additionally, the fine precipitates and inclusions of the "carbo-nitro-sulfides" including Ti, Nb, Zr, Ta, Hf and V, should totally satisfy the size and number described above.

The essential components of the spring steel in accordance with the present invention are three elements of C, Si and Mn as described below, with the remaining part thereof substantially comprising Fe. Their preferable contents are as follows. C; 0.3% or more to less than 0.7%

C is an element essentially contained in steel, and contributes to the increase of the strength (hardness) after quenching and tempering. If the C content is 0.3% or less, then, the strength (hardness) after quenching and tempering is unsatisfactory; if the content is 0.7% or more, alternatively, the toughness and ductility after quenching and tempering is deteriorated and additionally, the corrosion resistance is adversely affected. From the respect of the strength and toughness required for spring steel, more preferably C content is from 0.3 to 0.55%; so as to more certainly improve the resistance to hydrogen embrittlement and corrosion fatigue, the content is preferably within a range of 0.30 to 0.50%. Si: 0.1 to 4.0%

Si is an essential element for solid solution strengthening. When the Si content is less than 0.1%, the strength of the matrix after quenching and tempering becomes insufficient. When the Si content is more than 4.0%, the solution of carbides becomes insufficient during heating for quenching, and higher temperature is required for the uniform austenitizing, which excessively accelerates the decarbonization on the surface, thereby deteriorating the fatigue life of a spring. The Si content is preferably in the range from 1.0 to 3.0%. Mn: 0.005 to 2.0%

Different effects may be expected from Mn when added at an amount of 0.005% or more to less than 0.05% and at an amount of 0.05% or more to 2.0% or less. Firstly, the lower limit of Mn is defined from the respect of refining efficiency at a practical scale production. Because long-term refining is needed so as to decrease the Mn content to less than 0.005%, leading to the marked increase of the cost, the lower limit should be defined as described above on the practical reason.

When the Mn content is defined within a range of 0.005% or more to less than 0.05%, other elements improving hardenability (for example, Cr, Ni, Mo, etc.) should be contained sufficiently (at about 0.5% or more) in the steel. If the hardenable elements are added to steels excessively, supercooling structure will be observed in their microstructure. In such case, the Mn content suppressed to less than 0.05% is preferable because hard supercooling structure are hardly formed, which readily promotes cold formability such as wire drawing and which also suppresses the formation of coarse MnS frequently working as a fracture origin. The Mn content is defined within a range of 0.05% or more to 2.0% or less if elements to improve hardenability of the steel are at lower levels (about 0.5% or less). So as to actively enhance the hardenability, Mn should be contained at 0.05% or more. If the Mn content is excessive, however, the hardenability of steel is too much increased to readily generate supercooling structures. Thus, the upper limit of Mn addition should be 2.0%. The formation of MnS working as a fracture origin may then exist potentially, so that MnS should preferably be generated as less as possible, through the decrease of S content or the combination of adding other sulfide forming elements (Ti, Zr, etc.).

For the purpose of improving corrosion resistance on the following reason, it is effective for one or more elements among Cr, Ni, Mo, V, and Cu to be contained in the spring steel.

Cr: 5.0% or less (preferably, 0.05 to 5.0%)

Cr is an element to make amorphous and dense the rust produced on the surface layer in a corrosive environment thereby improving the corrosion resistance, and to improve the hardenability like Mn. To achieve these functions, Cr must be added in an amount of 0.05% or more. But if Cr is added excessively above 5.0%, carbides are hardly dissolved during heating for quenching, to adversely affect the strength and hardness. More preferable Cr content is within the range of 0.1 to 2.0%. Ni: 3.0% or less (preferably, 0.05 to 3.0%)

Ni is an element for enhancing the toughness of the material after quenching and tempering, making amorphous and dense the produced rust thereby improving the corrosion resistance, and improving the sag resistance as one of important spring characteristics. To achieve these functions, Ni must be added 0.05% or more, preferably, 0.1% or more. When the Ni content is more than 3.0%, the hardenability is excessively increased, and a supercooling structure is easily generated after rolling. The Ni content is preferably in the range from 0.1 to 1.0%.

Mo: 3.0% or less (preferably, 0.05 to 3.0%)

Mo is an element for improving the hardenability, and enhancing the corrosion resistance due to the absorption of molybdate ion produced in corrosive solution. Furthermore, Mo has an effect to increase the intergranular strength thereby improving the resistance to hydrogen embrittlement. These effects are efficiently exhibited at a content of 0.05% or more, preferably 0.1% or more. Because these effects are saturated at about 3.0%, however, further more addition is economically useless.

Cu: 1.0% or less (preferably, 0.01 to 1.0%)

Cu is an element being electrochemically noble more than Fe, and has a function to enhance the corrosion resistance. To achieve this function, Cu must be added in an amount of 0.01% or more. However, even when the Cu content is more than 1.0%, the effect is saturated, or rather, there occurs a fear of causing the embrittlement of the material during hot rolling. The Cu content is preferably in the range from 0.1 to 0.5%.

The following elements are included as other preferable elements to be contained, and the effects of the individual elements added may be exerted efficiently. At least one selected from the group consisting of Al, B, Co and W Any element of them can contribute to the improvement of the sag resistance through the increase of the toughness; additionally, Al refines grain size to improve the proof stress ratio; B has an effect to improve the hardenability to increase the intergranular strength; Co and W increase the strength and hardness after quenching and tempering; still additionally, B makes more dense rust generated on the surface, to improve the corrosion resistance; W forms tungstate ions in a corrosive solution to contribute to the improvement of the corrosion resistance. The effects of these elements are effectively exhibited at about 0.005% or more of Al, about 1 ppm or more of B, at about 0.01% or more of Co and about 0.01% or more of W. If Al is above 1.0%, however, the amount of oxide inclusions generated is increased and the size thereof is also coarse, both of which adversely affect the fatigue life; because the aforementioned effects of added B and Co are saturated at about 50 ppm and 5.0%, respectively, further addition thereof is economically useless; when W is above 1.0%, alternatively, the toughness of the steels material is adversely affected. From these respects, more preferable contents of the elements are within the following ranges; Al at 0.01 to 0.5%, B of5 to 30 ppm, Co at 0.5 to 3.0%, and W at 0.1 to 0.5%.

One or more of Ca, La, Ce and Rem

Any one of these elements contributes to the improvement of the corrosion resistance; Ca further is a forcibly deoxidizing element, and has a function to refine oxide based inclusions in steel and to contribute to the improvement of the toughness. The effect of improving the corrosion resistance is considered as follows: namely, when the corrosion of a steel proceeds, in a corrosion pit as the starting point of the corrosion fatigue, there occurs the following reaction:

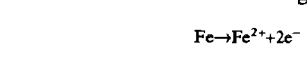

$$Fe \rightarrow Fe^{2+} + 2e^{-}$$

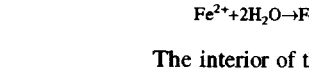

$$Fe^{2+} + 2H_2O \rightarrow Fe(OH)_2 + 2H^{+}$$

The interior of the corrosion pit is thus made acidic, and to keep the electric neutralization, $Cl^{-1}$ ions are collected therein from the exterior. As a result, the liquid in the corrosion pit made severely corrosive, which accelerates the growth of the corrosion pit. When appropriate amount of Ca, La, Ce and Rem are present in steel, they are dissolved in the liquid within the corrosion pit together with steel. However, since they are basic elements, the liquid thereof are made basic, to neutralize the liquid in the corrosion pit, thus significantly suppressing the growth of the corrosion pit as the starting point of the corrosion fatigue. To achieve this function, these outcome may be facilitated when the steel contains Ca of 0.1 ppm or more, and La, Ce and Rem at 0.001% or more, and more reliably 0.005% or more. When Ca is above 200 ppm, however, the refractory materials of the converter are severely damaged during steel refining; additionally, the effects of La, Ce and Rem are individually saturated at their individual contents of about 0.1%. Thus, any more addition thereof is useless, economically.

Because P as an impurity inevitably contaminated into steel, segregate to grain boundaries to decrease the grain boundary strength thereby causing intergranular fracture, P should be suppressed to about 0.02% or less. Furthermore, Zn, Sn, As and Sb as other impurities which occasionally may be contaminated into steel, similarly segregate to grain boundaries to decrease intergranular strength and tend to enhance hydrogen embrittlement thereby. Therefore, all of these elements should be suppressed to about 60 ppm or less individually.

Additionally, the elements of the spring steel to be used in accordance with the present invention should preferably satisfy the requirement of the following formula (I) in addition to the requirement of the contents of the individual contents. More specifically, the hydrogen embrittlement in a spring steel occurs due to the penetration of diffusive hydrogen into the grain boundaries, and the penetration of diffusive hydrogen adversely affects the corrosion resistance of the steel. It is then confirmed that the corrosion resistance of itself is improved by appropriate amounts of Cr, Ni, Mo, Cu, etc. contained in the steel but the material cost up due to the addition of greater amounts of these alloying elements and the processing cost up due to additional treatment such as annealing of rolled materials due to the increasing of hardenability, cannot be neglected. When the contents of C, Si, Mn, Cr, Ni and Mo in the steel are to be adjusted so that their contents may satisfy the relationship defined by the following formula (I), however, a spring steel containing smaller amounts of these alloying elements and having very excellent corrosion resistance may be produced without any annealing process for rolled materials.

$$2.5 \leqq (FP) \leqq 4.5 \quad (I)$$

(wherein $FP=(0.23|C|+0.1)\times(0.7|Si|+1)\times(3.5|Mn|+1)\times(2.2|Cr|+1)\times(0.4|Ni|+1)\times(3|Mo|+1)$, provided that |element| represents mass % of each element.)

If the FP value described above is less than 2.5, uniform hardening is hardly attained, involving difficulty in securing higher strength certainly; if the value is above 4.5, alternatively, supercooling structure may appear in microstructure of the steels after hot rolling so that the strength after pressing is 1300 MPa or more. Thus, annealing process is inevitable in drawing process, leading to the increase of the number of processes. If the contents of individual elements contained are to be adjusted so as to satisfy the relationship of the aforementioned formula (I), however, uniform hardening microstructure is attained during quenching and tempering to stabilize the higher strength with no appearance of supercooling structure in the hot rolled microstructure, whereby the strength is not enhanced excessively. Therefore, drawing process can be carried out without any softening process such as annealing process.

When the spring steel with the chemical composition described above into a suspension spring, the slabs are hot rolled into wire rods, which is then processed with quenching and tempering or which is subsequently subjected to oil tempering process to be adjusted to a given wire hardness (tensile strength) prior to processing into spring. Preferably, then, the prior austenite grain size is to be adjusted to 20 μm or less (more preferably, 15 μm or less); the hardness is to be adjusted to HRC 50 or more (more preferably, 52 or more); and the fracture toughness KIC is to be adjusted to 40 $MPam^{1/2}$ or more (more preferably, 50 $MPam^{1/2}$).

In those spring steels with a prior austenite grain size of 20 μm or less, therefore, the "carbo-nitro-sulfides" generating in the grain boundaries are so extremely fine that they can efficiently exert the function as a diffusive hydrogen trapping sites with almost no influence over the toughness and fatigue life. So as to obtain such fine austenite grain size, the conditions of the heating process for austenitization should satisfactorily be adjusted appropriately.

So as to secure satisfactory durability and sag resistance as a high-strength suspension spring and the like, wire rod hardness after quenching and tempering is also important. So as to secure satisfactory durability and sag resistance as suspension spring, the wire after quenching and tempering should have a hardness of HRC 50 or more and a fracture toughness value of 40 $MPam^{1/2}$. Less than HRC 50, the durability and sag resistance should be likely to be poor; and if the fracture toughness value is less than 40 $MPam^{1/2}$, satisfactory resistance to hydrogen embrittlement cannot be exerted through lower toughness. Generally taking account of durability, sag resistance, resistance to hydrogen embrittlement and the like, more preferable hardness is HRC 52 or more; and more preferable fracture toughness is 50 $MPam^{1/2}$ or more.

DESCRIPTION OF THE PREFERRED EMBODIMENTS

Examples will now be described in accordance with the present invention, but the invention is never limited to the following examples. Within the scopes as described above and below, modification and variation will be possible to carry out the invention. These modifications and variations are also included in the technical scope of the present invention.

EXAMPLE 1

Melting steels Nos.1 to 102 of the chemical components as shown in Tables 1 to 6 and subsequently casting the materials by ingot-making or by continuous casting, and preparing then billets of a 115-mm square by blooming, the billets were further processed into wire rods of a diameter of 14 mm by hot rolling. Each wire rod was drawn to a diameter of 12.5 mm, followed by quenching and tempering, to prepare a test piece for fracture toughness, a test piece for hydrogen embrittlement, a test piece for rotary bending corrosion fatigue, and a test piece for rotary bending fatigue. The conditions for tempering were adjusted so that the hardness might be HRC 53 to 55 within 350° to 450° C. for an hour.

The test piece for fracture toughness was a CT test piece, preliminarily introduced with fatigue crack of a length of about 3 mm. The test was carried out at room temperature in atmosphere, by using a 10-ton autograph tensile tester. The corrosion fatigue test was carried out by a process comprising dropwise adding an aqueous 5% NaCl solution at 35° C. into the test piece. All of the test pieces were shot peened under the same conditions at a stress of 784 MPa and a rotation of 100 rpm. The test of hydrogen embrittlement was carried out by dipping test pieces in a mixture solution of 0.5 mol/l H2SO4 and 0.01 mol/l KSCN (potassium rhodanate), through the bending of the piece at four points during cathode charge and applying a voltage at −700 mV vs SCE using a potentiostat. The stress was a bending stress at 1400 MPa. The rotary bending fatigue test was carried out after the test pieces were shot-peened under the same conditions. The testing stress was 881 MPa and 10 specimens were tested for each steel. The test was suspended at $1.0\times10^7$ times.

Further, EPMA (Electron Probe Micro Analyzer) was used to measure the size and number of the "carbo-nitro-sulfides" of Ti, Nb, Zr, Ta, Hf and V. More specifically, automatically operating EPMA so as to cover a testing surface area (long side/short side=5, the long side be in contact to a part of a 0.3-mm depth from the surface layer) of 20 $MM^2$ inside the 0.3-mm depth from the surface of the longitudinal section (passing through the center line) of a rotary bending test piece to count all inclusions therein, the size of inclusions whose average particle size of 3 μm or more were measured and elements of them were analyzed. For precipitates of an average particle size of less than 3 μm, furthermore, the specimens after hydrogen embrittlement test was used to identify the elements of the precipitates under 20 the observation areas in total, for each steel, using EPMA and Auger Electron Analyzer; concurrently, the size and number thereof were measured by photography (1,000 to 20,000 magnification); the number was corrected for a testing surface area of 20 $mm^2$.

Tables 1, 3, 5 and 6 show the compositions of the steels of the present invention; Tables 2 and 4 show the compositions of the steels of Comparative Examples; and Tables 7 to 12 show the results of the tests.

Tables 1 to 12 indicate what will be described below.

Examples of Nos.1 to 24, 44 to 70 and 90 to 102, satisfying all the requirements defined in accordance with the present invention, show good results in terms of any of resistance to hydrogen embrittlement, corrosion fatigue and fatigue. The Examples are far more excellent, compared with Comparative Examples of Nos. 25, 26, 27, 71, 72 and 73, with no Ti, Nb, Zr, Ta and Hf contained therein.

Among the Examples, those containing an appropriate amount of V show excellent results in terms of any of resistance to hydrogen embrittlement, corrosion fatigue and fatigue, compared with other Examples with no V contained therein. Steel (Nos. 4 to 24, 47 to 70) with the C contents within the most appropriate range of 0.30 to 0.50% have higher fracture toughness and longer hydrogen embrittlement cracking life. Even among those with the main contained elements satisfying the defined requirements, Comparative Examples (Nos. 31, 32, 77, and 78) with higher contents of P and S, or Zn, Sn, As, Sb, etc. which cause the size and number of coarse inclusions outside the preferable requirement, can hardly exhibit the effect of improving the hydrogen embrittlement cracking life.

From the respect of corrosion durability, those containing appropriate amounts of Ni, Cr and Mo as in Nos. 4 to 8, and 47 to 51 acquire far excellent corrosion fatigue life compared with Examples of Nos.1, 2, and 44 to 46 with no such elements contained therein. Furthermore, steels (Nos. 9 to 12, and 52 to 55) with appropriate amounts of Al, B, Co and W actively added therein so as to improve the strength and toughness, have the same performance from the respect of any of resistance of hydrogen embrittlement and corrosion fatigue life, as those of steels of Nos. 4 and 47 and the like. Steel materials (Nos. 13 to 16, and 56 to 59) with appropriate amounts of Ca, La, Ce and Rem added therein so as to improve corrosion resistance, have apparently improved corrosion fatigue life, compared with steels (Nos. 5, 47, and the like) never containing them.

With respect to the influences of the size and number of precipitates, those satisfying the preferable requirements of the present invention cause no break origined inclusions at fatigue tests, which indicates no adverse effect on fatigue life. On contrast, greater amounts of coarse inclusions are generated by the slower cooling rate during solidification in Comparative Examples Nos. 28 to 30 and 74 to 76, where the probability of fracture due to the coarse inclusions is so high that the fatigue life is extremely shortened.

With respect to the principal elements, C, Si and Mn, in steel, it is indicated that those with slight shortage of C contents (Nos. 33 and 79) have more or less low strength after quenching and tempering; and that those with too higher C contents (Nos. 34 and 80) tend to adversely have lower fracture toughness and deteriorated hydrogen embrittlement cracking life. In Nos. 35 and 81 with some shortage of Si, the hardness is slightly poor; in Nos. 36 and 82 with too much Si, the toughness is slightly low. In any of these Examples, the hydrogen embrittlement cracking life is likely to be not enough. If a constant amount of Cr is maintained, additionally, a steel with higher cold formability can be produced by suppressing addition of Mn to a lower level (Nos. 96 to 102). Those with higher contents of Mn, Ni, Cr and Mo (Nos. 38 to 41 and 84 to 87) tend to demonstrate lower hardness due to the presence of a lot of retained austenite. In Comparative Examples (Nos. 42, 43, 88 and 89) wherein the N and S contents are outside the defined requirements, the number of coarse inclusions of "carbo-nitro-sulfides" is increased, which indicates that the deterioration of fatigue life and the like is significant.

In Examples with FP values within the preferable range (Nos. 1, 3 to 5, 9, 10, 13 to 24, 44, 47, 48, 52, 53, 56–70) in accordance with the present invention, direct drawing process is possible with no need of annealing after rolling, whereby the simplification of the production process and cost saving can be achieved. In Examples (Nos. 1 to 5, 49 to 51, etc.) with contents of Ti, Nb, Zr, Ta, Hf, N and S within more preferable range, stable performance can be achieved from the respect of resistance to hydrogen embrittlement, corrosion durability and fatigue; in Examples (Nos. 17, 20, 60, 63 and 66) with slight shortage of these elements compared with their preferable range, the resistance to hydrogen embrittlement is more or less lower; in Examples (Nos. 18, 19, 21, 22, 61, 62, 64, 65, 67, 68) with greater contents of them, adversely, the fatigue life has lower values. Compared with Comparative Examples, however, these Examples have far more excellent resistance to hydrogen embrittlement and fatigue.

The present invention as described above can provide a spring steel with higher strength, higher stress resistance, excellent resistance to hydrogen embrittlement and fatigue, characterized in that the spring steel is produced by making a spring steel contain an appropriate amount of at least one or more of Ti, Nb, Zr, Ta, and Hf, thereby generating fine inclusions of the "carbo-nitro-sulfides" thereof to make the inclusions exert the effect of trapping diffusive hydrogen whereby the resistance to hydrogen embrittlement is enhanced, wherein the size and number of the coarse inclusions of the "carbo-nitro-sulfides" are regulated, thereby suppressing the decrease of the fatigue life.

TABLE 1

| | Chemical components (mass %) | | | | | | | | | | | | | | |
|---|---|---|---|---|---|---|---|---|---|---|---|---|---|---|---|
| Steel types | C | Si | Mn | Cu | Ni | Cr | Mo | V | Ti | Nb | N ppm | S ppm | other component | FP value | Necessity of annealing |
| Inventive steel 1 | 0.60 | 2.01 | 0.85 | 0 | 0 | 0.15 | 0 | 0 | 0.041 | 0 | 71 | 102 | — | 3.1 | not necessary |
| Inventive steel 2 | 0.54 | 1.49 | 0.85 | 0 | 0 | 0.74 | 0 | 0 | 0.049 | 0 | 92 | 111 | — | 4.9 | necessary |
| Inventive steel 3 | 0.42 | 1.71 | 0.20 | 0.21 | 0.35 | 1.10 | 0 | 0.15 | 0.050 | 0 | 45 | 62 | — | 2.9 | not necessary |
| Inventive steel 4 | 0.42 | 1.72 | 0.21 | 0.20 | 0.35 | 1.09 | 0 | 0.14 | 0.051 | 0 | 12 | 48 | — | 3.0 | not necessary |
| Inventive steel 5 | 0.44 | 1.65 | 0.19 | 0 | 0.40 | 0.90 | 0 | 0.20 | 0.042 | 0.031 | 42 | 53 | — | 2.5 | not necessary |
| Inventive steel 6 | 0.40 | 2.49 | 0.42 | 0 | 1.82 | 0.91 | 0.48 | 0.20 | 0.050 | 0 | 42 | 69 | — | 16.8 | necessary |
| Inventive steel 7 | 0.35 | 2.49 | 0.39 | 0 | 2.30 | 2.92 | 0.40 | 0.20 | 0 | 0.067 | 59 | 82 | — | 37.4 | necessary |
| Inventive steel 8 | 0.35 | 2.49 | 0.40 | 0 | 1.02 | 2.92 | 1.52 | 0 | 0.059 | 0 | 32 | 52 | — | 70.4 | necessary |
| Inventive steel 9 | 0.42 | 1.69 | 0.19 | 0 | 0.34 | 1.09 | 0 | 0 | 0.062 | 0 | 49 | 57 | Al: 0.03% | 2.8 | not necessary |
| Inventive steel 10 | 0.42 | 1.71 | 0.20 | 0 | 0.33 | 1.05 | 0 | 0.15 | 0.051 | 0 | 44 | 45 | B: 15 ppm | 2.8 | not necessary |
| Inventive steel 11 | 0.40 | 1.81 | 0.93 | 0 | 0.35 | 0.75 | 0.35 | 0 | 0 | 0.088 | 55 | 32 | Co: 0.70% | 11.7 | necessary |
| Inventive steel 12 | 0.41 | 1.76 | 0.83 | 0.58 | 0.38 | 0.60 | 0.40 | 0 | 0 | 0.049 | 79 | 66 | W: 0.21% | 10.2 | necessary |
| Inventive steel 13 | 0.42 | 1.75 | 0.20 | 0 | 0.42 | 0.91 | 0 | 0.20 | 0.052 | 0 | 49 | 32 | Ca: 12 ppm | 2.7 | not necessary |
| Inventive steel 14 | 0.44 | 1.72 | 0.19 | 0 | 0.39 | 1.00 | 0 | 0.15 | 0.051 | 0 | 51 | 38 | La: 0.04% | 2.8 | not necessary |
| Inventive steel 15 | 0.43 | 1.76 | 0.22 | 0 | 0.38 | 0.99 | 0 | 0.09 | 0.021 | 0 | 49 | 35 | Ce: 0.03% | 2.9 | not necessary |
| Inventive steel 16 | 0.42 | 1.75 | 0.23 | 0.20 | 0.41 | 1.04 | 0 | 0.06 | 0 | 0.081 | 32 | 40 | Rem: 0.04% | 3.1 | not necessary |
| Inventive steel 17 | 0.42 | 1.71 | 0.21 | 0 | 0.35 | 1.09 | 0 | 0.15 | 0.004 | 0 | 45 | 59 | — | 2.9 | not necessary |
| Inventive steel 18 | 0.42 | 1.72 | 0.20 | 0 | 0.34 | 1.09 | 0 | 0.15 | 0.120 | 0 | 44 | 60 | — | 2.9 | not necessary |
| Inventive steel 19 | 0.42 | 1.71 | 0.19 | 0 | 0.36 | 1.10 | 0 | 0.15 | 0.320 | 0 | 45 | 87 | — | 2.9 | not necessary |
| Inventive steel 20 | 0.41 | 1.72 | 0.20 | 0.21 | 0.35 | 1.10 | 0 | 0.15 | 0 | 0.003 | 45 | 43 | — | 2.9 | not necessary |
| Inventive steel 21 | 0.42 | 1.71 | 0.21 | 0.21 | 0.35 | 1.08 | 0 | 0.15 | 0 | 0.150 | 45 | 54 | — | 2.9 | not necessary |
| Inventive steel 22 | 0.42 | 1.70 | 0.20 | 0.21 | 0.35 | 1.10 | 0 | 0.15 | 0 | 0.340 | 45 | 64 | — | 2.9 | not necessary |
| Inventive steel 23 | 0.44 | 1.71 | 0.19 | 0 | 0.36 | 1.10 | 0 | 0.08 | 0.051 | 0 | 97 | 73 | — | 2.9 | not necessary |
| Inventive steel 24 | 0.42 | 1.70 | 0.21 | 0 | 0.36 | 1.08 | 0 | 0.09 | 0.050 | 0 | 159 | 172 | — | 2.9 | not necessary |

TABLE 2

| | Chemical components (mass %) | | | | | | | | | | | | | FP | Necessity of |
|---|---|---|---|---|---|---|---|---|---|---|---|---|---|---|---|
| Steel types | C | Si | Mn | Cu | Ni | Cr | Mo | V | Ti | Nb | N ppm | S ppm | other component | value | annealing |
| Comparative steel 25 | 0.60 | 2.01 | 0.84 | 0 | 0 | 0.16 | 0 | 0 | 0 | 0 | 71 | 132 | — | 3.1 | not necessary |
| Comparative steel 26 | 0.54 | 1.49 | 0.88 | 0 | 0 | 0.71 | 0 | 0 | 0 | 0 | 73 | 117 | — | 4.3 | not necessary |
| Comparative steel 27 | 0.42 | 1.70 | 0.19 | 0.21 | 0.36 | 1.12 | 0 | 0.15 | 0 | 0 | 45 | 75 | — | 2.9 | not necessary |
| Comparative steel 28 | 0.59 | 2.00 | 0.84 | 0 | 0 | 0.15 | 0 | 0 | 0.041 | 0 | 139 | 122 | — | 3.0 | not necessary |
| Comparative steel 29 | 0.51 | 2.01 | 0.89 | 0 | 0 | 0 | 0 | 0.15 | 0.084 | 0 | 99 | 116 | — | 3.2 | not necessary |
| Comparative steel 30 | 0.41 | 1.69 | 0.19 | 0 | 0.35 | 0.98 | 0 | 0.14 | 0.092 | 0 | 149 | 75 | — | 2.6 | not necessary |
| Inventive steel 1 | 0.60 | 2.01 | 0.85 | 0 | 0 | 0.15 | 0 | 0 | 0.039 | 0 | 71 | 50 | P: 0.006% Zn: 0, Sn: 4 As: 12, Sb: 3 | 3.1 | not necessary |
| Comparative steel 31 | 0.60 | 2.02 | 0.87 | 0 | 0 | 0.15 | 0 | 0 | 0.040 | 0 | 75 | 290 | P: 0.026% | 3.1 | not necessary |
| Comparative steel 32 | 0.60 | 2.02 | 0.37 | 0 | 0 | 0.15 | 0 | 0 | 0.021 | 0.051 | 75 | 82 | Zn: 82, Sn: 69 As: 62, Sb: 77 | 3.1 | not necessary |
| Comparative steel 33 | 0.28 | 1.72 | 0.42 | 0 | 0 | 1.90 | 0.52 | 0 | 0 | 0 | 75 | 72 | — | 12.2 | necessary |
| Comparative steel 34 | 0.70 | 1.30 | 0.42 | 0 | 0 | 0.50 | 0 | 0 | 0 | 0 | 48 | 83 | — | 2.6 | not necessary |
| Comparative steel 35 | 0.41 | 0.05 | 0.42 | 0 | 0 | 0.99 | 0 | 0 | 0 | 0 | 49 | 76 | — | 1.6 | not necessary |
| Comparative steel 36 | 0.41 | 1.96 | 0.52 | 0 | 0.31 | 0.95 | 0 | 0 | 0 | 0 | 48 | 65 | — | 8.0 | necessary |

TABLE 2-continued

| Steel types | Chemical components (mass %) C | Si | Mn | Cu | Ni | Cr | Mo | V | Ti | Nb | N ppm | S ppm | other component | FP value | Necessity of annealing |
|---|---|---|---|---|---|---|---|---|---|---|---|---|---|---|---|
| Comparative steel 37 | 0.43 | 1.72 | 0.02 | 0 | 0 | 1.12 | 0 | 0 | 0 | 0 | 50 | 49 | — | 1.7 | not necessary |
| Comparative steel 38 | 0.42 | 1.71 | 2.90 | 0 | 0.36 | 1.11 | 0 | 0 | 0 | 0 | 50 | 74 | — | 19.3 | necessary |
| Comparative steel 39 | 0.42 | 1.78 | 0.52 | 0 | 3.62 | 1.10 | 0 | 0 | 0 | 0 | 51 | 52 | — | 4.8 | not necessary |
| Comparative steel 40 | 0.43 | 1.71 | 0.56 | 0 | 0 | 5.22 | 0 | 0 | 0 | 0 | 50 | 48 | — | 16.4 | necessary |
| Comparative steel 41 | 0.43 | 1.71 | 0.61 | 0 | 0 | 1.10 | 3.20 | 0 | 0 | 0 | 49 | 77 | — | 47.3 | necessary |
| Comparative steel 42 | 0.41 | 1.74 | 0.21 | 0 | 0.35 | 1.02 | 0 | 0.13 | 0.048 | 0 | 259 | 82 | — | 2.8 | not necessary |
| Comparative steel 43 | 0.41 | 1.73 | 0.19 | 0 | 0.34 | 0.99 | 0 | 0.14 | 0.052 | 0 | 89 | 377 | — | 2.6 | not necessary |

The contents of Zn, Sn, As and Sb among other components are represented in ppm.

TABLE 3

| Steel types | Chemical components (mass %) C | Si | Mn | Cu | Ni | Cr | Mo | V | Zr | Ta | Hf | Ti | Nb | N ppm | S ppm | other component | FP value | Necessity of annealing |
|---|---|---|---|---|---|---|---|---|---|---|---|---|---|---|---|---|---|---|
| Inventive steel 44 | 0.61 | 2.01 | 0.84 | 0 | 0 | 0.15 | 0 | 0 | 0.06 | 0 | 0 | 0 | 0 | 76 | 110 | — | 3.1 | not necessary |
| Inventive steel 45 | 0.56 | 1.49 | 0.84 | 0 | 0 | 0.76 | 0 | 0 | 0 | 0.05 | 0 | 0 | 0 | 98 | 107 | — | 4.9 | necessary |
| Inventive steel 46 | 0.54 | 1.49 | 0.85 | 0 | 0 | 0.73 | 0 | 0 | 0 | 0 | 0.07 | 0 | 0 | 43 | 63 | — | 4.9 | necessary |
| Invention steel 47 | 0.42 | 1.72 | 0.21 | 0.21 | 0.34 | 1.08 | 0 | 0.15 | 0.03 | 0 | 0 | 0.02 | 0 | 42 | 42 | — | 2.9 | not necessary |
| Invention steel 48 | 0.44 | 1.64 | 0.19 | 0 | 0.41 | 0.90 | 0 | 0.20 | 0 | 0.02 | 0 | 0.04 | 0.03 | 45 | 58 | — | 2.9 | not necessary |
| Invention steel 49 | 0.40 | 2.50 | 0.42 | 0 | 1.82 | 0.91 | 0.48 | 0.20 | 0 | 0 | 0.02 | 0.05 | 0 | 44 | 61 | — | 16.8 | necessary |
| Invention steel 50 | 0.35 | 2.49 | 0.40 | 0 | 2.29 | 2.92 | 0.40 | 0.20 | 0.02 | 0.02 | 0 | 0 | 0.04 | 62 | 73 | — | 37.4 | necessary |
| Invention steel 51 | 0.35 | 2.49 | 0.41 | 0 | 1.00 | 2.92 | 1.51 | 0 | 0 | 0.03 | 0.02 | 0 | 0 | 36 | 74 | — | 70.4 | necessary |
| Invention steel 52 | 0.42 | 1.69 | 0.19 | 0 | 0.34 | 1.08 | 0 | 0 | 0.05 | 0 | 0 | 0.06 | 0 | 44 | 69 | Al: 0.03% | 2.8 | not necessary |
| Invention steel 53 | 0.42 | 1.71 | 0.20 | 0 | 0.33 | 1.05 | 0 | 0.15 | 0.05 | 0 | 0 | 0.05 | 0 | 46 | 65 | B: 15 ppm | 2.8 | not necessary |
| Invention steel 54 | 0.41 | 1.80 | 0.93 | 0 | 0.35 | 0.75 | 0.35 | 0 | 0 | 0.04 | 0 | 0 | 0.06 | 53 | 53 | Co: 0.70% | 11.7 | necessary |
| Invention steel 55 | 0.41 | 1.76 | 0.93 | 0.58 | 0.36 | 0.59 | 0.41 | 0 | 0 | 0 | 0.03 | 0 | 0.04 | 74 | 81 | W: 0.21% | 10.2 | necessary |
| Invention steel 56 | 0.42 | 1.75 | 0.19 | 0 | 0.42 | 0.93 | 0 | 0.20 | 0 | 0.04 | 0 | 0.05 | 0 | 45 | 49 | Ca: 12 ppm | 2.7 | not necessary |
| Invention steel 57 | 0.43 | 1.72 | 0.19 | 0 | 0.39 | 1.01 | 0 | 0.15 | 0 | 0.04 | 0 | 0.05 | 0 | 54 | 51 | La: 0.04% | 2.8 | not necessary |
| Invention steel 58 | 0.43 | 1.76 | 0.22 | 0 | 0.36 | 1.00 | 0 | 0.09 | 0 | 0.04 | 0 | 0.02 | 0 | 47 | 50 | Ce: 0.03% | 2.9 | not necessary |
| Invention steel 59 | 0.42 | 1.74 | 0.22 | 0.20 | 0.43 | 1.05 | 0 | 0.06 | 0 | 0.04 | 0 | 0 | 0.08 | 29 | 45 | Rem: 0.04% | 3.1 | not necessary |
| Invention steel 60 | 0.42 | 1.70 | 0.21 | 0 | 0.36 | 1.08 | 0 | 0.15 | 0.004 | 0 | 0 | 0 | 0 | 45 | 58 | — | 2.9 | not necessary |
| Invention steel 61 | 0.42 | 1.71 | 0.20 | 0 | 0.34 | 1.10 | 0 | 0.15 | 0.120 | 0 | 0 | 0 | 0 | 44 | 57 | — | 2.9 | not necessary |
| Invention steel 62 | 0.42 | 1.72 | 0.19 | 0 | 0.36 | 1.10 | 0 | 0.15 | 0.320 | 0 | 0 | 0 | 0 | 45 | 60 | — | 2.9 | not necessary |
| Invention steel 63 | 0.41 | 1.72 | 0.20 | 0 | 0.35 | 1.10 | 0 | 0.15 | 0 | 0.003 | 0 | 0 | 0 | 48 | 63 | — | 2.9 | not necessary |
| Invention steel 64 | 0.42 | 1.71 | 0.21 | 0 | 0.35 | 1.08 | 0 | 0.15 | 0 | 0.142 | 0 | 0 | 0 | 47 | 69 | — | 2.9 | not necessary |
| Invention steel 65 | 0.42 | 1.70 | 0.20 | 0 | 0.35 | 1.10 | 0 | 0.15 | 0 | 0.322 | 0 | 0 | 0 | 45 | 77 | — | 2.9 | not necessary |
| Invention steel 66 | 0.41 | 1.70 | 0.20 | 0.19 | 0.35 | 1.10 | 0 | 0.15 | 0 | 0 | 0.004 | 0 | 0 | 45 | 65 | — | 2.9 | not necessary |

TABLE 3-continued

| Steel types | Chemical components (mass %) C | Si | Mn | Cu | Ni | Cr | Mo | V | Zr | Ta | Hf | Ti | Nb | N ppm | S ppm | other component | FP value | Necessity of annealing |
|---|---|---|---|---|---|---|---|---|---|---|---|---|---|---|---|---|---|---|
| Inven-steel 67 | 0.42 | 1.71 | 0.21 | 0.22 | 0.35 | 1.08 | 0 | 0.15 | 0 | 0 | 0.120 | 0 | 0 | 49 | 69 | — | 2.9 | not necessary |
| Inven-steel 68 | 0.42 | 1.70 | 0.20 | 0.21 | 0.35 | 1.10 | 0 | 0.15 | 0 | 0 | 0.311 | 0 | 0 | 49 | 63 | — | 2.9 | not necessary |
| Inven-steel 69 | 0.44 | 1.71 | 0.19 | 0 | 0.36 | 1.10 | 0 | 0.08 | 0.051 | 0 | 0 | 0 | 0 | 92 | 62 | — | 2.9 | not necessary |
| Inven-steel 70 | 0.42 | 1.70 | 0.21 | 0 | 0.36 | 1.08 | 0 | 0.09 | 0.050 | 0 | 0 | 0 | 0 | 164 | 93 | — | 2.9 | not necessary |

TABLE 4

| Steel types | Chemical components (mass %) C | Si | Mn | Cu | Ni | Cr | Mo | V | Zr | Ta | Hf | Ti | Nb | N ppm | S ppm | other component | FP value | Necessity of annealing |
|---|---|---|---|---|---|---|---|---|---|---|---|---|---|---|---|---|---|---|
| Com-parative steel 71 | 0.60 | 2.01 | 0.84 | 0 | 0 | 0.16 | 0 | 0 | 0 | 0 | 0 | 0 | 0 | 71 | 132 | — | 3.1 | not necessary |
| Com-parative steel 72 | 0.54 | 1.49 | 0.88 | 0 | 0 | 0.71 | 0 | 0 | 0 | 0 | 0 | 0 | 0 | 73 | 128 | — | 4.3 | not necessary |
| Com-parative steel 73 | 0.42 | 1.70 | −0.19 | 0.21 | 0.36 | 1.12 | 0 | 0.15 | 0 | 0 | 0 | 0 | 0 | 45 | 65 | — | 2.9 | not necessary |
| Com-parative steel 74 | 0.59 | 2.00 | 0.84 | 0 | 0 | 0.15 | 0 | 0 | 0.042 | 0 | 0 | 0 | 0 | 129 | 136 | — | 3.0 | not necessary |
| Com-parative steel 75 | 0.61 | 2.01 | 0.89 | 0 | 0 | 0 | 0 | 0.15 | 0 | 0.079 | 0 | 0 | 0 | 92 | 96 | — | 3.2 | not necessary |
| Com-parative steel 76 | 0.41 | 1.69 | 0.19 | 0 | 0.35 | 0.98 | 0 | 0.14 | 0 | 0 | 0.089 | 0 | 0 | 158 | 87 | — | 2.6 | not necessary |
| Inven-tive steel 44 | 0.61 | 2.01 | 0.84 | 0 | 0 | 0.15 | 0 | 0 | 0.041 | 0 | 0 | 0 | 0 | 72 | 49 | P: 0.006% Zn: 0, Sn: 3 As: 15, Sb: 5 | 3.1 | not necessary |
| Com-parative steel 77 | 0.60 | 1.99 | 0.84 | 0 | 0 | 0.16 | 0 | 0 | 0.042 | 0 | 0 | 0 | 0 | 74 | 310 | P: 0.029% | 3.1 | not necessary |
| Com-parative steel 78 | 0.59 | 2.00 | 0.85 | 0 | 0 | 0.15 | 0 | 0 | 0.032 | 0 | 0.041 | 0 | 0 | 77 | 82 | Zn: 85, Sn: 72 As: 63, Sb: 82 | 3.1 | not necessary |
| Com-parative steel 79 | 0.28 | 1.72 | 0.42 | 0 | 0 | 1.90 | 0.52 | 0 | 0 | 0 | 0 | 0 | 0 | 75 | 72 | — | 12.2 | necessary |
| Com-parative steel 80 | 0.70 | 1.30 | 0.42 | 0 | 0 | 0.50 | 0 | 0 | 0 | 0 | 0 | 0 | 0 | 48 | 83 | — | 2.6 | not necessary |
| Com-parative steel 81 | 0.41 | 0.05 | 0.42 | 0 | 0 | 0.99 | 0 | 0 | 0 | 0 | 0 | 0 | 0 | 49 | 76 | — | 1.6 | not necessary |
| Com-parative steel 82 | 0.41 | 4.50 | 0.52 | 0 | 0.31 | 0.95 | 0 | 0 | 0 | 0 | 0 | 0 | 0 | 48 | 65 | — | 8.0 | necessary |
| Com-parative steel 83 | 0.43 | 1.72 | 0.02 | 0 | 0 | 1.12 | 0 | 0 | 0 | 0 | 0 | 0 | 0 | 50 | 49 | — | 1.7 | not necessary |
| Com-parative steel 84 | 0.42 | 1.71 | 2.90 | 0 | 0.36 | 1.11 | 0 | 0 | 0 | 0 | 0 | 0 | 0 | 50 | 74 | — | 19.3 | necessary |
| Com-parative steel 85 | 0.42 | 1.70 | 0.52 | 0 | 3.62 | 1.10 | 0 | 0 | 0 | 0 | 0 | 0 | 0 | 51 | 52 | — | 4.8 | not necessary |
| Com-parative steel 86 | 0.43 | 1.71 | 0.56 | 0 | 0 | 5.22 | 0 | 0 | 0 | 0 | 0 | 0 | 0 | 50 | 48 | — | 16.4 | necessary |

TABLE 4-continued

| Steel types | Chemical components (mass %) | | | | | | | | | | | | | | | | FP value | Necessity of annealing |
|---|---|---|---|---|---|---|---|---|---|---|---|---|---|---|---|---|---|---|
| | C | Si | Mn | Cu | Ni | Cr | Mo | V | Zr | Ta | Hf | Ti | Nb | N ppm | S ppm | other component | | |
| Comparative steel 87 | 0.43 | 1.71 | 0.61 | 0 | 0 | 1.10 | 3.20 | 0 | 0 | 0 | 0 | 0 | 0 | 49 | 77 | — | 47.3 | necessary |
| Comparative steel 88 | 0.41 | 1.71 | 0.20 | 0 | 0.36 | 1.02 | 0 | 0.13 | 0.13 | 0 | 0 | 0 | 0 | 252 | 89 | — | 2.7 | not necessary |
| Comparative steel 89 | 0.42 | 1.73 | 0.19 | 0 | 0.35 | 0.99 | 0 | 0.14 | 0.05 | 0 | 0 | 0 | 0 | 79 | 357 | — | 2.7 | not necessary |

The Contents of Zn, Sn, As and Sb among other Components are represented in ppm.

TABLE 5

| Steel types | Chemical components (mass %) | | | | | | | | | | | | | | | | FP value | Necessity of annealing |
|---|---|---|---|---|---|---|---|---|---|---|---|---|---|---|---|---|---|---|
| | C | Si | Mn | Cu | Ni | Cr | Mo | V | Zr | Ta | Hf | Ti | Nb | N ppm | S ppm | other component | | |
| Inventive steel 90 | 0.42 | 1.71 | 0.20 | 0 | 0.31 | 1.06 | 0 | 0.17 | 0.06 | 0 | 0 | 0 | 0.04 | 76 | 52 | — | 2.8 | necessary |
| Inventive steel 91 | 0.41 | 1.72 | 0.22 | 0 | 0.35 | 1.05 | 0 | 0.15 | 0.04 | 0 | 0.05 | 0 | 0 | 98 | 57 | — | 2.7 | necessary |
| Inventive steel 92 | 0.42 | 1.70 | 0.21 | 0 | 0.36 | 1.03 | 0 | 0.15 | 0.05 | 0.05 | 0 | 0 | 0 | 43 | 63 | — | 2.8 | necessary |
| Inventive steel 93 | 0.42 | 1.72 | 0.21 | 0.21 | 0.34 | 1.02 | 0 | 0.15 | 0.03 | 0.03 | 0 | 0.05 | 0 | 42 | 42 | — | 2.8 | necessary |
| Inventive steel 94 | 0.44 | 1.54 | 0.19 | 0 | 0.35 | 1.08 | 0 | 0.14 | 0.03 | 0 | 0 | 0.04 | 0.03 | 45 | 58 | — | 2.8 | necessary |
| Inventive steel 95 | 0.42 | 1.68 | 0.22 | 0 | 0.35 | 1.06 | 0 | 0.15 | 0 | 0 | 0.02 | 0.05 | 0.03 | 44 | 61 | — | 2.9 | necessary |

TABLE 6

| Steel types | Chemical components (mass %) | | | | | | | | | | | | | | | | FP value | Necessity of annealing |
|---|---|---|---|---|---|---|---|---|---|---|---|---|---|---|---|---|---|---|
| | C | Si | Mn | Cu | Ni | Cr | Mo | V | Zr | Ta | Hf | Ti | Nb | N ppm | S ppm | other component | | |
| Inventive steel 96 | 0.41 | 1.69 | 0.05 | — | — | 0.95 | — | — | — | — | — | 0.051 | — | 55 | 81 | — | 1.5 | not necessary |
| Inventive steel 97 | 0.39 | 1.71 | 0.06 | — | — | 0.97 | — | — | — | — | — | 0.049 | 0.04 | 49 | 92 | — | 1.6 | not necessary |
| Inventive steel 98 | 0.39 | 1.69 | 0.09 | — | — | 0.95 | — | 0.25 | — | — | — | 0.052 | — | 49 | 58 | — | 1.7 | not necessary |
| Inventive steel 99 | 0.41 | 1.71 | 0.08 | — | 0.36 | 0.96 | — | — | — | — | — | 0.049 | — | 40 | 67 | — | 1.9 | not necessary |
| Inventive steel 100 | 0.41 | 1.68 | 0.06 | 0.18 | — | 0.96 | — | — | — | — | — | 0.043 | — | 38 | 103 | — | 1.6 | not necessary |
| Inventive steel 101 | 0.42 | 1.73 | 0.09 | 0.19 | 0.3 | 0.95 | — | — | — | — | — | 0.052 | — | 54 | 88 | — | 2.0 | not necessary |

TABLE 6-continued

| Steel types | Chemical components (mass %) C | Si | Mn | Cu | Ni | Cr | Mo | V | Zr | Ta | Hf | Ti | Nb | N ppm | S ppm | other component | FP value | Necessity of annealing |
|---|---|---|---|---|---|---|---|---|---|---|---|---|---|---|---|---|---|---|
| Inventive steel 102 | 0.41 | 1.76 | 0.008 | — | — | 0.94 | 0.2 | — | — | — | — | 0.053 | — | 53 | 74 | — | 2.2 | not necessary |

TABLE 7

| Steel types | Hardness (HRC) after hardening and tempering | Resistance to hydrogen embrittlement: Old austenite particle size (μm) | Fracture toughness ($K_{IC}$) | Hydrogen embrittlement cracking life (sec) | Corrosion fatigue life (times) | Fatigue performance: Number of fractures due to the presence of inclusions of Ti, Nb, Zr, Ta and Hf: $10^5$–$10^6$ times | $10^6$–$10^7$ times | Number of inclusions of Ti, Nb, Zr, Ta and Hf: 20 μm more | 10–20 μm | 5–10 μm | 0.5–5 μm |
|---|---|---|---|---|---|---|---|---|---|---|---|
| Inventive steel 1 | 53.4 | 12 | 42 | 501 | $6.9 \times 10^4$ | 0 | 1 | 1 | 41 | 402 | >3000 |
| Inventive steel 2 | 53.6 | 9 | 45 | 612 | $9.4 \times 10^4$ | 0 | 2 | 3 | 38 | 481 | >3000 |
| Inventive steel 3 | 53.2 | 8 | 57 | 1127 | $1.6 \times 10^5$ | 0 | 0 | 0 | 9 | 165 | >10000 |
| Inventive steel 4 | 53.6 | 9 | 58 | 1202 | $1.7 \times 10^5$ | 0 | 0 | 0 | 0 | 145 | >10000 |
| Inventive steel 5 | 53.2 | 10 | 52 | 893 | $1.3 \times 10^5$ | 0 | 0 | 0 | 3 | 189 | >10000 |
| Inventive steel 6 | 53.8 | 17 | 71 | 1982 | $2.4 \times 10^5$ | 0 | 0 | 0 | 10 | 191 | >10000 |
| Inventive steel 7 | 54.0 | 19 | 70 | 2032 | $3.2 \times 10^5$ | 0 | 0 | 0 | 12 | 259 | >10000 |
| Inventive steel 8 | 53.8 | 19 | 65 | 1308 | $2.8 \times 10^5$ | 0 | 0 | 0 | 6 | 122 | >10000 |
| Inventive steel 9 | 53.5 | 12 | 57 | 1152 | $1.4 \times 10^5$ | 0 | 0 | 0 | 6 | 282 | >10000 |
| Inventive steel 10 | 53.5 | 11 | 55 | 998 | $1.2 \times 10^5$ | 0 | 0 | 0 | 12 | 229 | >10000 |
| Inventive steel 11 | 53.5 | 15 | 56 | 1027 | $1.6 \times 10^5$ | 0 | 0 | 0 | 13 | 175 | >10000 |
| Inventive steel 12 | 53.4 | 13 | 51 | 742 | $1.3 \times 10^5$ | 0 | 0 | 0 | 14 | 409 | >5000 |
| Inventive steel 13 | 53.6 | 14 | 54 | 795 | $2.1 \times 10^5$ | 0 | 0 | 0 | 11 | 276 | >10000 |
| Inventive steel 14 | 53.2 | 13 | 55 | 809 | $1.9 \times 10^5$ | 0 | 0 | 0 | 12 | 129 | >10000 |
| Inventive steel 15 | 53.4 | 16 | 54 | 699 | $1.9 \times 10^5$ | 0 | 0 | 0 | 4 | 121 | >10000 |
| Inventive steel 16 | 53.6 | 13 | 52 | 712 | $1.7 \times 10^5$ | 0 | 0 | 0 | 17 | 343 | >10000 |
| Inventive steel 17 | 53.4 | 17 | 53 | 832 | $1.4 \times 10^5$ | 0 | 0 | 0 | 0 | 52 | >10000 |
| Inventive steel 18 | 53.5 | 9 | 56 | 1145 | $1.7 \times 10^5$ | 0 | 1 | 0 | 9 | 448 | >5000 |

TABLE 7-continued

| Steel types | Hardness (HRC) after hardening and tempering | Resistance to hydrogen embrittlement: Old austenite particle size (μm) | Fracture toughness ($K_{IC}$) | Hydrogen embrittlement cracking life (sec) | Corrosion fatigue life (times) | Fatigue performance: Number of fractures due to the presence of inclusions of Ti, Nb, Zr, Ta and Hf: $10^5$–$10^6$ times | $10^6$–$10^7$ times | Number of inclusions of Ti, Nb, Zr, Ta and Hf: 20 μm more | 10–20 μm | 5–10 μm | 0.5–5 μm |
|---|---|---|---|---|---|---|---|---|---|---|---|
| Inventive steel 19 | 53.2 | 8 | 57 | 1121 | $1.6 \times 10^5$ | 0 | 2 | 0 | 19 | 485 | >5000 |
| Inventive steel 20 | 53.2 | 18 | 54 | 801 | $1.4 \times 10^5$ | 0 | 0 | 0 | 0 | 42 | >10000 |
| Inventive steel 21 | 53.3 | 9 | 56 | 1098 | $1.6 \times 10^5$ | 0 | 0 | 0 | 21 | 399 | >5000 |
| Inventive steel 22 | 53.5 | 8 | 57 | 1035 | $1.6 \times 10^5$ | 0 | 3 | 0 | 35 | 432 | >5000 |
| Inventive steel 23 | 53.4 | 6 | 55 | 999 | $1.4 \times 10^5$ | 0 | 2 | 3 | 32 | 389 | >10000 |
| Inventive steel 24 | 53.7 | 7 | 53 | 938 | $1.4 \times 10^5$ | 0 | 3 | 4 | 28 | 465 | >10000 |

TABLE 8

| Steel types | Hardness (HRC) after hardening and tempering | Resistance to hydrogen embrittlement: Old austenite particle size (μm) | Fracture toughness ($K_{IC}$) | Hydrogen embrittlement cracking life (sec) | Corrosion fatigue life (times) | Fatigue performance: Number of fractures due to the presence of inclusions of Ti, Nb, Zr, Ta and Hf: $10^5$–$10^6$ times | $10^6$–$10^7$ times | Number of inclusions of Ti, Nb, Zr, Ta and Hf: 20 μm more | 10–20 μm | 5–10 μm | 0.5–5 μm |
|---|---|---|---|---|---|---|---|---|---|---|---|
| Comparative steel 25 | 53.4 | 24 | 39 | 28 | $3.2 \times 10^4$ | 0 | 0 | 0 | 3 | 9 | <100 |
| Comparative steel 26 | 53.6 | 17 | 43 | 42 | $4.1 \times 10^4$ | 0 | 0 | 0 | 6 | 10 | <100 |
| Comparative steel 27 | 53.2 | 18 | 52 | 298 | $7.3 \times 10^4$ | 0 | 0 | 0 | 2 | 8 | <100 |
| Comparative steel 28 | 53.7 | 9 | 40 | 256 | $5.8 \times 10^4$ | 6 | 4 | 12 | 81 | 706 | >3000 |
| Comparative steel 29 | 54.0 | 18 | 39 | 97 | $5.5 \times 10^4$ | 7 | 3 | 18 | 68 | 886 | >3000 |
| Comparative steel 30 | 53.9 | 16 | 50 | 487 | $7.7 \times 10^4$ | 4 | 6 | 3 | 36 | 964 | >3000 |
| Comparative steel 31 | 53.5 | 14 | 32 | 38 | $4.3 \times 10^4$ | 0 | 0 | 0 | 27 | 593 | >3000 |
| Comparative steel 32 | 53.5 | 14 | 35 | 82 | $4.1 \times 10^4$ | 0 | 0 | 0 | 31 | 631 | >3000 |
| Comparative steel 33 | 48.9 | 31 | — | — | — | — | — | 1 | 6 | 16 | <100 |
| Comparative steel 34 | 53.4 | 25 | 30 | 8 | $2.2 \times 10^4$ | — | — | 0 | 5 | 20 | <100 |
| Comparative steel 35 | 47.6 | 32 | — | — | — | — | — | 0 | 11 | 10 | <100 |

TABLE 8-continued

| Steel types | Hardness (HRC) after hardening and tempering | Resistance to hydrogen embrittlement: Old austenite particle size (μm) | Fracture toughness ($K_{IC}$) | Hydrogen embrittlement cracking life (sec) | Corrosion fatigue life (times) | Fatigue performance: Number of fractures due to the presence of inclusions of Ti, Nb, Zr, Ta and Hf: $10^5$–$10^6$ times | $10^6$–$10^7$ times | Number of inclusions of Ti, Nb, Zr, Ta and Hf: 20 μm more | 10–20 μm | 5–10 μm | 0.5–5 μm |
|---|---|---|---|---|---|---|---|---|---|---|---|
| Comparative steel 36 | 55.5 | 40 | 40 | 123 | $4.8 \times 10^4$ | — | — | 0 | 13 | 25 | <100 |
| Comparative steel 37 | 48.2 | 42 | — | — | — | — | — | 0 | 9 | 16 | <100 |
| Comparative steel 38 | 48.7 | 39 | — | — | — | — | — | 0 | 3 | 20 | <100 |
| Comparative steel 39 | 49.2 | 32 | — | — | — | — | — | 0 | 13 | 31 | <100 |
| Comparative steel 40 | 49.1 | 42 | — | — | — | — | — | 0 | 12 | 35 | <100 |
| Comparative steel 41 | 49.5 | 35 | — | — | — | — | — | 0 | 11 | 41 | <100 |
| Comparative steel 42 | 53.6 | 15 | 39 | 759 | $1.4 \times 10^5$ | 4 | 5 | 7 | 40 | 989 | >10000 |
| Comparative steel 43 | 53.5 | 14 | 37 | 711 | $1.5 \times 10^5$ | 3 | 7 | 6 | 28 | 772 | >10000 |

TABLE 9

| Steel types | Hardness (HRC) after hardening and tempering | Resistance to hydrogen embrittlement: Old austenite particle size (μm) | Fracture toughness ($K_{IC}$) | Hydrogen embrittlement cracking life (sec) | Corrosion fatigue life (times) | Fatigue performance: Number of fractures due to the presence of inclusions of Ti, Nb, Zr, Ta and Hf: $10^5$–$10^6$ times | $10^6$–$10^7$ times | Number of inclusions of Ti, Nb, Zr, Ta and Hf: 20 μm more | 10–20 μm | 5–10 μm | 0.5–5 μm |
|---|---|---|---|---|---|---|---|---|---|---|---|
| Inventive steel 44 | 53.5 | 11 | 42 | 455 | $5.8 \times 10^4$ | 0 | 1 | 2 | 44 | 398 | >3000 |
| Inventive steel 45 | 53.6 | 7 | 44 | 508 | $9.1 \times 10^4$ | 0 | 2 | 4 | 40 | 471 | >3000 |
| Inventive steel 46 | 53.5 | 10 | 43 | 349 | $8.2 \times 10^5$ | 0 | 0 | 0 | 12 | 483 | >5000 |
| Inventive steel 47 | 53.2 | 10 | 57 | 1036 | $1.2 \times 10^5$ | 0. | 0 | 0 | 8 | 148 | >10000 |
| Inventive steel 48 | 53.2 | 12 | 52 | 769 | $1.3 \times 10^5$ | 0 | 0 | 0 | 4 | 179 | >10000 |
| Inventive steel 49 | 53.8 | 15 | 71 | 1659 | $2.2 \times 10^5$ | 0 | 0 | 0 | 10 | 197 | >10000 |
| Inventive steel 50 | 54.0 | 18 | 70 | 1897 | $2.8 \times 10^5$ | 0 | 0 | 0 | 14 | 278 | >10000 |
| Inventive steel 51 | 53.8 | 17 | 65 | 1287 | $2.7 \times 10^5$ | 0 | 0 | 0 | 6 | 138 | >10000 |
| Inventive steel 52 | 53.5 | 13 | 57 | 999 | $1.3 \times 10^5$ | 0 | 0 | 0 | 6 | 290 | >10000 |
| Inventive steel 53 | 53.5 | 9 | 55 | 799 | $1.1 \times 10^5$ | 0 | 0 | 0 | 14 | 246 | >10000 |
| Inventive steel 54 | 53.9 | 13 | 56 | 1049 | $1.5 \times 10^5$ | 0 | 0 | 0 | 16 | 247 | >10000 |
| Inventive steel 55 | 53.4 | 15 | 51 | 598 | $1.3 \times 10^5$ | 0 | 0 | 0 | 14 | 459 | >3000 |
| Inventive steel 56 | 53.6 | 17 | 54 | 823 | $1.9 \times 10^5$ | 0 | 0 | 0 | 16 | 256 | >10000 |
| Inventive steel 57 | 53.2 | 13 | 55 | 757 | $2.0 \times 10^5$ | 0 | 0 | 0 | 13 | 119 | >10000 |

TABLE 9-continued

| Steel types | Hardness (HRC) after hardening and tempering | Resistance to hydrogen embrittlement: Old austenite particle size (μm) | Fracture toughness ($K_{IC}$) | Hydrogen embrittlement cracking life (sec) | Corrosion fatigue life (times) | Fatigue performance: Number of fractures due to the presence of inclusions of Ti, Nb, Zr, Ta and Hf: $10^5$–$10^6$ times | $10^6$–$10^7$ times | Number of inclusions of Ti, Nb, Zr, Ta and Hf: 20 μm more | 10–20 μm | 5–10 μm | 0.5–5 μm |
|---|---|---|---|---|---|---|---|---|---|---|---|
| Inventive steel 58 | 53.4 | 18 | 54 | 632 | $1.8 \times 10^5$ | 0 | 0 | 0 | 4 | 174 | >10000 |
| Inventive steel 59 | 53.9 | 12 | 52 | 514 | $1.5 \times 10^5$ | 0 | 0 | 0 | 17 | 326 | >10000 |
| Inventive steel 60 | 53.4 | 17 | 53 | 812 | $1.4 \times 10^5$ | 0 | 0 | 0 | 0 | 35 | >10000 |
| Inventive steel 61 | 53.5 | 9 | 56 | 1022 | $1.6 \times 10^5$ | 0 | 1 | 0 | 13 | 462 | >5000 |
| Inventive steel 62 | 53.2 | 8 | 57 | 991 | $1.5 \times 10^5$ | 0 | 0 | 0 | 22 | 445 | >5000 |
| Inventive steel 63 | 53.2 | 18 | 54 | 781 | $1.3 \times 10^5$ | 0 | 0 | 0 | 0 | 58 | >10000 |
| Inventive steel 64 | 53.3 | 9 | 56 | 1018 | $1.6 \times 10^5$ | 0 | 1 | 0 | 20 | 368 | >5000 |
| Inventive steel 65 | 53.5 | 8 | 57 | 985 | $1.6 \times 10^5$ | 0 | 3 | 0 | 35 | 417 | >5000 |
| Inventive steel 66 | 53.4 | 8 | 55 | 759 | $1.4 \times 10^5$ | 0 | 0 | 0 | 0 | 49 | >10000 |
| Inventive steel 67 | 53.7 | 7 | 53 | 938 | $1.5 \times 10^5$ | 0 | 3 | 0 | 26 | 435 | >5000 |
| Inventive steel 68 | 53.4 | 8 | 55 | 899 | $1.5 \times 10^5$ | 0 | 2 | 0 | 38 | 359 | >5000 |
| Inventive steel 69 | 53.7 | 7 | 53 | 908 | $1.4 \times 10^5$ | 0 | 3 | 4 | 26 | 465 | >5000 |
| Inventive steel 70 | 53.7 | 7 | 53 | 888 | $1.4 \times 10^5$ | 0 | 3 | 5 | 25 | 465 | >5000 |

TABLE 10

| Steel types | Hardness (HRC) after hardening and tempering | Resistance to hydrogen embrittlement: Old austenite particle size (μm) | Fracture toughness ($K_{IC}$) | Hydrogen embrittlement cracking life (sec) | Corrosion fatigue life (times) | Fatigue performance: Number of fractures due to the presence of inclusions of Ti, Nb, Zr, Ta and Hf: $10^5$–$10^6$ times | $10^6$–$10^7$ times | Number of inclusions of Ti, Nb, Zr, Ta and Hf: 20 μm more | 10–20 μm | 5–10 μm | 0.5–5 μm |
|---|---|---|---|---|---|---|---|---|---|---|---|
| Comparative steel 71 | 53.4 | 24 | 39 | 28 | $3.2 \times 10^4$ | 0 | 0 | 0 | 3 | 9 | <100 |
| Comparative steel 72 | 53.6 | 17 | 43 | 42 | $4.1 \times 10^4$ | 0 | 0 | 0 | 6 | 10 | <100 |
| Comparative steel 73 | 53.2 | 18 | 52 | 298 | $7.3 \times 10^4$ | 0 | 0 | 0 | 2 | 8 | <100 |
| Comparative steel 74 | 53.7 | 9 | 40 | 256 | $5.8 \times 10^4$ | 5 | 4 | 16 | 54 | 741 | >3000 |
| Comparative steel 75 | 54.0 | 18 | 39 | 97 | $5.5 \times 10^4$ | 7 | 3 | 17 | 82 | 892 | >3000 |
| Comparative steel 76 | 53.9 | 16 | 50 | 487 | $7.7 \times 10^4$ | 3 | 6 | 9 | 48 | 921 | >3000 |
| Comparative steel 77 | 53.5 | 14 | 32 | 38 | $4.3 \times 10^4$ | 0 | 0 | 0 | 27 | 593 | >3000 |
| Comparative steel 78 | 53.5 | 14 | 35 | 82 | $4.1 \times 10^4$ | 0 | 0 | 0 | 31 | 631 | >3000 |
| Comparative steel 79 | 48.9 | 31 | — | — | — | — | — | 1 | 6 | 16 | <100 |

TABLE 10-continued

| Steel types | Hardness (HRC) after hardening and tempering | Resistance to hydrogen embrittlement: Old austenite particle size (μm) | Fracture toughness ($K_{IC}$) | Hydrogen embrittlement cracking life (sec) | Corrosion fatigue life (times) | Fatigue performance: Number of fractures due to the presence of inclusions of Ti, Nb, Zr, Ta and Hf $10^5$–$10^6$ times | $10^6$–$10^7$ times | Number of inclusions of Ti, Nb, Zr, Ta and Hf: 20 μm more | 10–20 μm | 5–10 μm | 0.5–5 μm |
|---|---|---|---|---|---|---|---|---|---|---|---|
| Comparative steel 80 | 53.4 | 25 | 30 | 8 | $2.2 \times 10^4$ | — | — | 0 | 5 | 20 | <100 |
| Comparative steel 81 | 47.6 | 32 | — | — | — | — | — | 0 | 11 | 10 | <100 |
| Comparative steel 82 | 55.5 | 40 | 40 | 123 | $4.8 \times 10^4$ | — | — | 0 | 13 | 25 | <100 |
| Comparative steel 83 | 48.2 | 42 | — | — | — | — | — | 0 | 9 | 16 | <100 |
| Comparative steel 84 | 48.7 | 39 | — | — | — | — | — | 0 | 3 | 20 | <100 |
| Comparative steel 85 | 49.2 | 32 | — | — | — | — | — | 0 | 13 | 31 | <100 |
| Comparative steel 86 | 49.1 | 42 | — | — | — | — | — | 0 | 12 | 35 | <100 |
| Comparative steel 87 | 49.5 | 35 | — | — | — | — | — | 0 | 11 | 41 | <100 |
| Comparative steel 88 | 53.6 | 49 | 16 | 642 | $1.4 \times 10^5$ | 5 | 5 | 8 | 49 | 939 | >10000 |
| Comparative steel 89 | 53.5 | 48 | 18 | 652 | $1.3 \times 10^5$ | 4 | 6 | 6 | 52 | 732 | >10000 |

TABLE 11

| Steel types | Hardness (HRC) after hardening and tempering | Resistance to hydrogen embrittlement: Old austenite particle size (μm) | Fracture toughness ($K_{IC}$) | Hydrogen embrittlement cracking life (sec) | Corrosion fatigue life (times) | Fatigue performance: Number of fractures due to the presence of inclusions of Ti, Nb, Zr, Ta and Hf $10^5$–$10^6$ times | $10^6$–$10^7$ times | Number of inclusions of Ti, Nb, Zr, Ta and Hf: 20 μm more | 10–20 μm | 5–10 μm | 0.5–5 μm |
|---|---|---|---|---|---|---|---|---|---|---|---|
| Inventive steel 90 | 53.4 | 10 | 56 | 955 | $1.1 \times 10^4$ | 0 | 0 | 0 | 13 | 421 | <10000 |
| Inventive steel 91 | 53.6 | 7 | 54 | 872 | $1.2 \times 10^4$ | 0 | 0 | 0 | 10 | 431 | >10000 |
| Inventive steel 92 | 53.5 | 9 | 58 | 849 | $1.3 \times 10^4$ | 0 | 0 | 0 | 14 | 483 | >10000 |
| Inventive steel 93 | 53.2 | 10 | 57 | 1021 | $1.2 \times 10^4$ | 0 | 0 | 0 | 8 | 348 | >10000 |
| Inventive steel 94 | 53.2 | 12 | 54 | 1069 | $1.1 \times 10^4$ | 0 | 0 | 0 | 9 | 429 | >10000 |
| Inventive steel 95 | 53.8 | 10 | 55 | 1101 | $1.2 \times 10^4$ | 0 | 0 | 0 | 10 | 444 | >10000 |

TABLE 12

| Steel types | Hardness (HRC) after hardening and tempering | Resistance to hydrogen embrittlement: Old austenite particle size (μm) | Fracture toughness ($K_{IC}$) | Hydrogen embrittlement cracking life (sec) | Corrosion fatigue life (times) | Fatigue performance: Number of fractures due to the presence of inclusions of Ti, Nb, Zr, Ta and Hf: $10^5$–$10^6$ times | $10^6$–$10^7$ times | Number of inclusions of Ti, Nb, Zr, Ta and Hf: 20 μm more | 10–20 μm | 5–10 μm | 0.5–5 μm |
|---|---|---|---|---|---|---|---|---|---|---|---|
| Inventive steel 96 | 53.1 | 11 | 55 | 877 | $1.4 \times 10^5$ | 0 | 0 | 0 | 11 | 403 | <10000 |
| Inventive steel 97 | 54.2 | 7 | 54 | 904 | $1.3 \times 10^5$ | 0 | 0 | 0 | 13 | 443 | >10000 |
| Inventive steel 98 | 53.3 | 7 | 53 | 901 | $1.5 \times 10^5$ | 0 | 0 | 0 | 9 | 457 | >10000 |
| Inventive steel 99 | 52.9 | 12 | 58 | 867 | $1.7 \times 10^5$ | 0 | 0 | 0 | 12 | 376 | >10000 |
| Inventive steel 100 | 53.4 | 11 | 57 | 899 | $1.6 \times 10^5$ | 0 | 0 | 0 | 14 | 553 | >10000 |
| Inventive steel 101 | 53.2 | 12 | 58 | 867 | $1.6 \times 10^5$ | 0 | 0 | 0 | 8 | 465 | >10000 |
| Inventive steel 102 | 54.1 | 8 | 54 | 856 | $1.6 \times 10^5$ | 0 | 0 | 0 | 12 | 387 | >10000 |

We claim:

1. A spring steel, comprising at least one element selected from the group consisting of Ti at 0.001 to 0.5% (the term "%" herein means "mass %", the same is true hereinbelow), Nb at 0.001 to 0.5%, Zr at 0.001 to 0.5%, Ta at 0.001 to 0.5% and Hf at 0.001 to 0.5%, and also comprising C at 0.3% to 0.55%, Si at 1.49 to 2.50%, Mn at 0.005 to 2.0%, N of 1 to 200 ppm and S of 5 to 300 ppm, with a balance beginning essentially Fe and inevitable impurities, wherein a great number of fine precipitates including carbides, nitrides, sulfides and/or their compounds having an average particle size of less than 5 μm and comprising at least one element selected from the group consisting of Ti Nb, Zr, Ta and Hf, are at least dispersed in a testing area;

said testing area defined by a region of a depth of 0.3 mm or more from a surface with no inclusion of a center part and having an area of 20 $mm^2$.

2. A spring steel with excellent resistance to hydrogen embrittlement and fatigue according to claim 1, wherein coarse inclusions including carbides, nitrides, sulfides and/or their compounds, containing at least one element selected from the group consisting of Ti, Nb, Zr, Ta, and Hf in the testing area satisfy the following requirements;

the size and number of coarse inclusions;

the number of coarse inclusions of an average particle size of 5 to 10 μm should be 500 or less;

the number of coarse inclusions of an average particle size of more than 10 μm to 20 μm or less should be 50 or less; and the number of coarse inclusions of an average particle size of more than 20 μm should be 10 or less.

3. A spring steel according to claim 1, containing V 0.005 to 1.0%, wherein fine precipitates including carbides, nitrides, sulfides and/or their compounds, containing at least one element selected from the group consisting of Ti, Nb, Zr, Ta, and Hf satisfy the requirements described above.

4. A spring steel according to claim 2, containing V 0.005 to 1.0%, wherein coarse inclusions including carbides, nitrides, sulfides and/or their compounds, containing at least one element selected from the group consisting of Ti, Nb, Zr, Ta, and Hf satisfy the requirements described above.

5. A spring steel according to any one of claims 1 to 4, having an prior austenite grain diameter of 20 μm or less after having been quenched and tempered, an HRC hardness of 50 or more and a fracture toughness value (KIC) of 40 $MPam^{1/2}$ or more.

6. A spring steel according to claim 1, wherein the steel contains at least one element selected from the group consisting of Ni at 3.0% or less, Cr at 5.0% or less, Mo at 3.0% or less and Cu at 1.0% or less as another element.

7. A spring steel according to claim 6, wherein the steel contains at least one element selected from the group consisting of Al at 1.0% or less, B of 50 ppm or less, Co at 5.0% or less and W at 1.0% or less as another element.

8. A spring steel according to claims 6 or 7, wherein the steel contains at least one element selected from the group consisting of Ca of 200 ppm or less, La at 0.5% or less, Ce at 0.5% or less and Rem at 0.5% or less as another element.

9. A spring steel according to claim 1, wherein the inevitable impurities in the steel include P at 0.02% or less.

10. A spring steel according to claim 9, wherein other impurities contained in the steel are Zn of 60 ppm or less, Sn of 60 ppm or less, As of 60 ppm or less and Sb of 60 ppm or less.

11. A spring steel according to any one of claims 1 or 6, wherein the steel satisfies the requirement of the following formula (I);

$$2.5 \leqq (FP) \leqq 4.5 \quad (1)$$

where, $FP=(0.23|C|+0.1)\times(0.7|Si|+1)\times(3.5|Mn|+1)\times(2.2|Cr|+1)\times(0.4|Ni|+1)\times(3|Mo|+1)$, provided that represents mass % of each element).

12. The spring steel according to claim 1, wherein said fine precipitates in said testing area comprises at least 60% of all precipitates.

13. The spring steel according to claim 1, wherein said fine precipitates in said testing area comprises at least 95% of all precipitates.

* * * * *